US012497955B2

(12) United States Patent
Li et al.

(10) Patent No.: US 12,497,955 B2
(45) Date of Patent: Dec. 16, 2025

(54) PUMP ASSEMBLY AND PROPORTIONING MACHINE

(71) Applicant: Zhengzhou Sanhua Technology & Industry Co., Ltd., Xingyang (CN)

(72) Inventors: Huan Li, Xingyang (CN); Yuan Li, Xingyang (CN)

(73) Assignee: ZHENGZHOU SANHUA TECHNOLOGY & INDUSTRY CO., LTD., Henan (CN)

( * ) Notice: Subject to any disclaimer, the term of this patent is extended or adjusted under 35 U.S.C. 154(b) by 4 days.

(21) Appl. No.: 18/927,999

(22) Filed: Oct. 26, 2024

(65) Prior Publication Data

US 2025/0146479 A1 May 8, 2025

(30) Foreign Application Priority Data

Nov. 8, 2023 (CN) ..... 202323028820.5

(51) Int. Cl.
*F04B 13/02* (2006.01)
*F04B 9/02* (2006.01)

(52) U.S. Cl.
CPC ..... *F04B 13/02* (2013.01); *F04B 9/02* (2013.01)

(58) Field of Classification Search
CPC ..... F04B 13/02; F04B 9/02; F04B 49/007; F04B 17/03; F04B 23/04
See application file for complete search history.

(56) References Cited

U.S. PATENT DOCUMENTS

| | | | | |
|---|---|---|---|---|
| 9,677,555 | B2 * | 6/2017 | Kamen | G16H 20/17 |
| 2010/0185322 | A1 * | 7/2010 | Bylsma | B01F 35/20 222/145.5 |
| 2012/0164004 | A1 * | 6/2012 | Thomeer | F04B 37/12 417/338 |
| 2012/0167672 | A1 * | 7/2012 | Miller | B01L 3/50273 73/61.59 |
| 2020/0246822 | A1 * | 8/2020 | Shen | F04B 49/20 |

* cited by examiner

*Primary Examiner* — Hoang M Nguyen
(74) *Attorney, Agent, or Firm* — The Sun IP Law

(57) ABSTRACT

Provided are a pump assembly and a proportioning machine. The pump assembly includes a driving mechanism, including a driving motor; a first pump body; a second pump body; and a third pump body. The first pump body and the second pump body are in transmission connection, when the driving motor rotates along a first direction, a rotating shaft of the third pump body does not rotate, the driving motor drives a rotating shaft of the second pump body to rotate, the second pump body drives a rotating shaft of the first pump body to rotate, when the driving motor rotates along a second direction, the rotating shafts of the first pump body and the second pump body do not rotate, the driving motor drives the rotating shaft of the third pump body to rotate, and the first direction and the second direction are opposite.

19 Claims, 14 Drawing Sheets

PUMP ASSEMBLY AND PROPORTIONING MACHINE

CROSS-REFERENCE TO RELATED APPLICATION

This application claims the priority of Patent Application Ser. No. 202323028820.5, entitled "Pump Assembly and Proportioning Machine" filed with China National Intellectual Property Administration on Nov. 8, 2023.

TECHNICAL FIELD

The present disclosure relates to the technical field of varnish proportioning, in particular to a pump assembly and a proportioning machine.

BACKGROUND OF THE INVENTION

After a paint is sprayed on an automobile or other equipment, a layer of varnish needs to be sprayed for protection, the varnish includes a curing agent and a thermosetting resin in a certain proportion, and a diluent is added according to requirements. Generally, a proportioning machine is adopted for proportioning, an existing proportioning machine is provided with a pump assembly and a storage module of liquid raw materials, the pump assembly is connected with a discharge end of the storage module, driven by a power apparatus, the pump assembly conveys the liquid raw materials to a valve assembly connected with the discharge end, and then discharge is completed. The pump assembly generally includes three pump bodies, a thermosetting resin, a curing agent and a diluent are respectively filled in the three pump bodies, since the diluent needs to be added according to requirements of customers, at least two motors are generally required to be disposed to respectively drive the three pump bodies, so that the varnish required by the customers may be prepared, resulting in relatively high manufacturing cost.

SUMMARY OF THE INVENTION

A main objective of the present disclosure is to provide a pump assembly and a proportioning machine, which may solve a problem that in an existing proportioning machine, a plurality of motors need to be disposed for driving a plurality of pump bodies respectively, resulting in relatively high manufacturing cost.

In order to realize the objective, according to one aspect of the present disclosure, a pump assembly is provided. The pump assembly includes a driving mechanism, including a driving motor; a first pump body, configured to extract a first solution; a second pump body, configured to extract a second solution; and a third pump body, configured to extract a diluent, the first pump body and the second pump body are in transmission connection, the second pump body and the third pump body are both in driving connection with the driving motor, when the driving motor rotates along a first direction, a rotating shaft of the third pump body does not rotate, the driving motor drives a rotating shaft of the second pump body to rotate, the rotating shaft of the second pump body drives a rotating shaft of the first pump body to rotate, when the driving motor rotates along a second direction, the rotating shafts of the first pump body and the second pump body do not rotate, the driving motor drives the rotating shaft of the third pump body to rotate, and the first direction and the second direction are opposite.

In some embodiments, the pump assembly further includes a first transmission mechanism and a second transmission mechanism, the driving motor is in driving connection with the second pump body and the third pump body through the first transmission mechanism, and the second pump body is in transmission connection with the first pump body through the second transmission mechanism.

In some embodiments, the first transmission mechanism includes a first chain wheel, a second chain wheel, a first one-way bearing, a second one-way bearing and a chain, the chain is meshed with a motor shaft of the driving motor, rotatable directions of the first one-way bearing and the second one-way bearing are opposite, the first chain wheel is installed on the rotating shaft of the second pump body through the first one-way bearing, the second chain wheel is installed on the rotating shaft of the third pump body through the second one-way bearing, the chain sleeves peripheries of the first chain wheel and the second chain wheel, and the first chain wheel and the second chain wheel are both meshed with the chain.

In some embodiments, the second transmission mechanism includes a first synchronous belt wheel, a second synchronous belt wheel and a synchronous belt, the first synchronous belt wheel is installed on the rotating shaft of the first pump body, the second synchronous belt wheel is installed on the rotating shaft of the second pump body, and the first synchronous belt wheel and the second synchronous belt wheel are in transmission connection through the synchronous belt.

In some embodiments, the pump assembly further includes an overload prevention assembly, the overload prevention assembly is installed on the motor shaft of the driving motor, the overload prevention assembly includes a driving adjusting part and a transmission part, the transmission part is meshed with the chain, and the driving adjusting part is configured to be capable of driving the transmission part to rotate.

In some embodiments, the driving adjusting part includes a speed reducer, a fixed seat and a compression structure, a driving shaft is disposed at an output end of the speed reducer, the transmission part, the fixed seat and the compression structure are all installed on the driving shaft, the fixed seat is located between the transmission part and the compression structure, the compression structure is located on a side, away from the speed reducer, of the fixed seat, the compression structure has a driving state and a driving relieving state, when the compression structure is in the driving state, the compression structure is able to drive the transmission part to rotate, and when the compression structure is in the driving relieving state, the compression structure cannot drive the transmission part to rotate.

In some embodiments, a through hole is formed in the fixed seat, at least one steel ball is disposed in the through hole, the compression structure is configured to be capable of exerting pressure to the at least one steel ball, a plurality of protrusions are disposed on a top of the transmission part, the plurality of protrusions are arranged along a circumferential direction of the transmission part at intervals, the at least one steel ball is configured to be capable of being clamped between adjacent two protrusions, a driving gear is disposed at a bottom of the transmission part, and the driving gear is meshed with the chain.

In some embodiments, the compression structure includes an adjusting piece, an elastic piece, a first pressing plate and a second pressing plate, a first end of the elastic piece abuts against the first pressing plate, a second end of the elastic piece abuts against the second pressing plate, the second pressing plate abuts against one of the at least one steel ball away from the transmission part, the adjusting piece is located on a side, away from the second pressing plate, of the first pressing plate, and the adjusting piece is able to move along the axial direction of the driving shaft, so as to adjust a position of the first pressing plate on the driving shaft.

In some embodiments, the pump assembly further includes a tension mechanism, the tension mechanism is located between the first chain wheel and the second chain wheel, the tension mechanism includes a tension seat and a tension shaft, a strip groove is formed in the tension seat, a screw rod is disposed in the strip groove in a penetration manner, a length extension direction of the screw rod is the same as a length extension direction of the strip groove, both ends of the screw rod penetrate out of the strip groove, a first end of the tension shaft is in threaded match with the screw rod, a tension wheel is disposed at a second end of the tension shaft, and the tension wheel is meshed with the chain.

According to another aspect of the present disclosure, a proportioning machine is provided, which includes the pump assembly described above, and a liquid storage mechanism, and a liquid discharge end of the liquid storage mechanism communicates with a liquid outlet end of the pump assembly.

In some embodiments, the liquid storage mechanism includes a first liquid storage unit, a second liquid storage unit and a third liquid storage unit, a first solution is filled in the first liquid storage unit, a liquid outlet end of the first liquid storage unit communicates with a liquid inlet end of the first pump body, a second solution is filled in the second liquid storage unit, a liquid outlet end of the second liquid storage unit communicates with a liquid inlet end of the second pump body, the diluent is filled in the third liquid storage unit, and a liquid outlet end of the third liquid storage unit communicates with a liquid inlet end of the third pump body.

By adoption of the technical solution of the present disclosure, the driving motor rotates along the first direction, the first pump body and the second pump body respectively extract and pump the first solution and the second solution out, after mixing, the first solution and the second solution may be cured to form a varnish, a user may add the diluent to the proportioned varnish according to requirements, when the diluent needs to be added, the driving motor rotates along the second direction, in such a case, the first pump body and the second pump body do not work, the third pump body works, and the third pump body extracts and pumps the diluent out. Compared with an existing proportioning machine, in the present disclosure, the pump assembly only needs to be driven by one driving motor, a plurality of driving motors and corresponding transmission structures do not need to be disposed, and thus manufacturing cost may be reduced.

BRIEF DESCRIPTION OF DRAWINGS

The accompanying drawings, which constitute a part of the present disclosure, are used to provide a further understanding of the present disclosure, and the exemplary embodiments of the present disclosure and the description thereof are used to explain the present disclosure, but do not constitute improper limitations to the present disclosure. In the drawings.

The drawings include the following reference signs.

1. Driving motor; 2. First pump body; 3. Second pump body; 4. Third pump body; 5. First chain wheel; 6. Second chain wheel; 7. Second inching explosion-roof button; 8. Shell; 9. Chain; 10. First synchronous belt wheel; 11. Second synchronous belt wheel; 12. Synchronous belt; 13. Overload prevention assembly; 14. Speed reducer; 15. Fixed seat; 16. Compression structure; 17. Driving shaft; 18. Through hole; 19. Steel ball; 20. Transmission part; 21. Bulge; 22. Driving gear; 23. Adjusting piece; 24. Elastic piece; 25. First pressing plate; 26. Second pressing plate; 27. Tension mechanism; 28. Tension seat; 29. Tension shaft; 30. Strip groove; 31. Screw rod; 32. Tension wheel; 33. Liquid storage mechanism; 34. First liquid storage unit; 35. Second liquid storage unit; 36. Third liquid storage unit; 37. Nozzle paint pipe cover; 38. Tray nozzle holder; 39. Column valve three-nozzle assembly; 40. Three-nozzle valve body; 41. Pipe joint; 42. Paint outlet; 43. Three-nozzle valve rod; 44. Plunger piston nozzle pull rod; 45. First handle; 46. Nozzle upper driving arm; 47. Second handle; 48. Column valve nozzle tension spring seat; 49. First tension spring; 50. Nozzle stop valve; 51. Nozzle stop valve wrench; 52. Nozzle switch guide plate; 53. Second tension spring; 54. Filter; 55. Spray gun; 56. First inching explosion-proof button; 57. Rolling bearing; 60. Switch valve driving arm; 70. Switch valve driving shaft; 80. Compression spring baffle plate; 90. Explosion-proof travel switch; 100. Connector; and 200. Rotating rod.

DETAILED DESCRIPTION OF THE INVENTION

It is to be noted that the embodiments and features in the embodiments of the present disclosure may be combined with each other without conflict. the present disclosure will now be described in detail with reference to the accompanying drawings and the embodiments.

Figure 1:
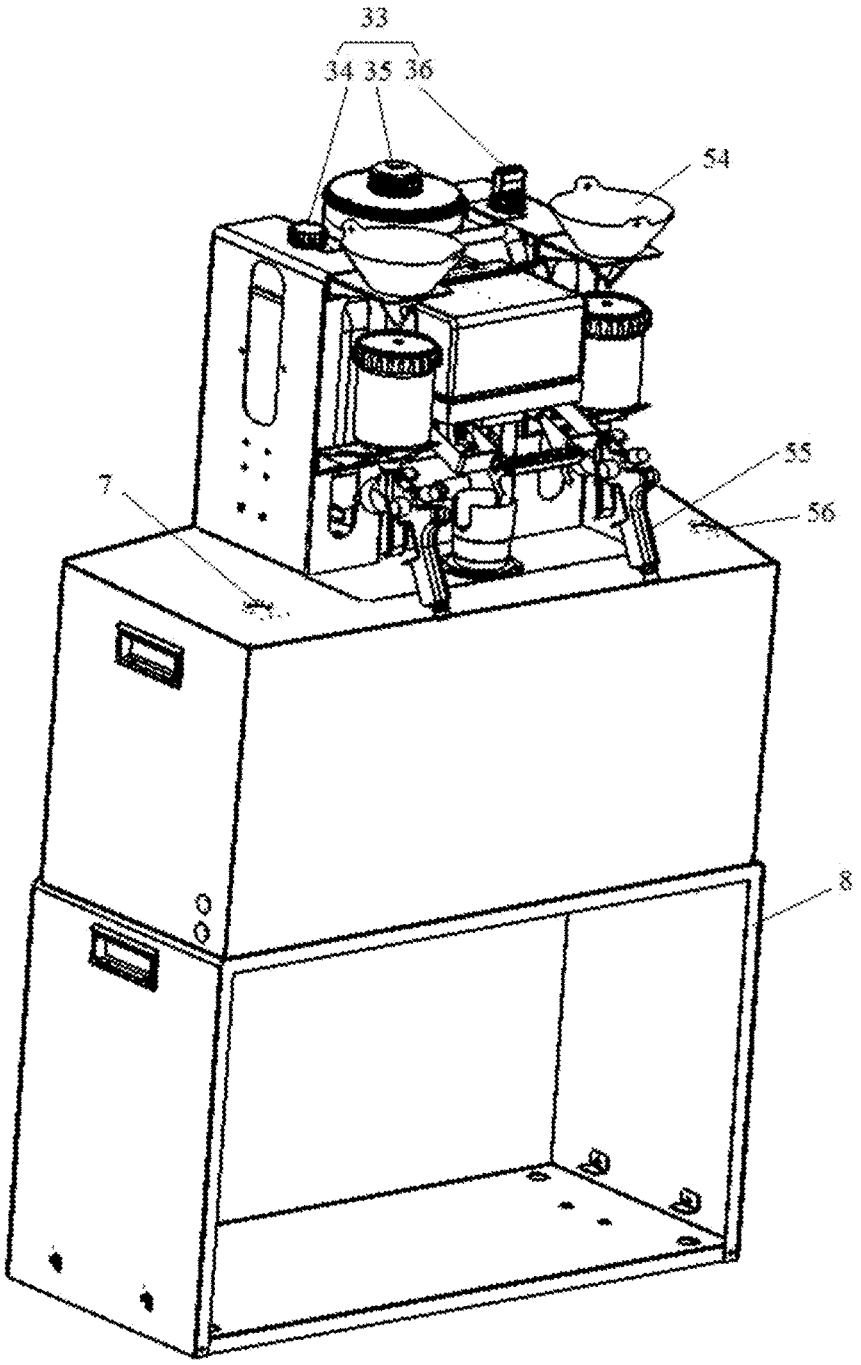
FIG. 1 illustrates a schematic diagram of an overall structure of a proportioning machine according to an embodiment of the present disclosure.
Figure 2:
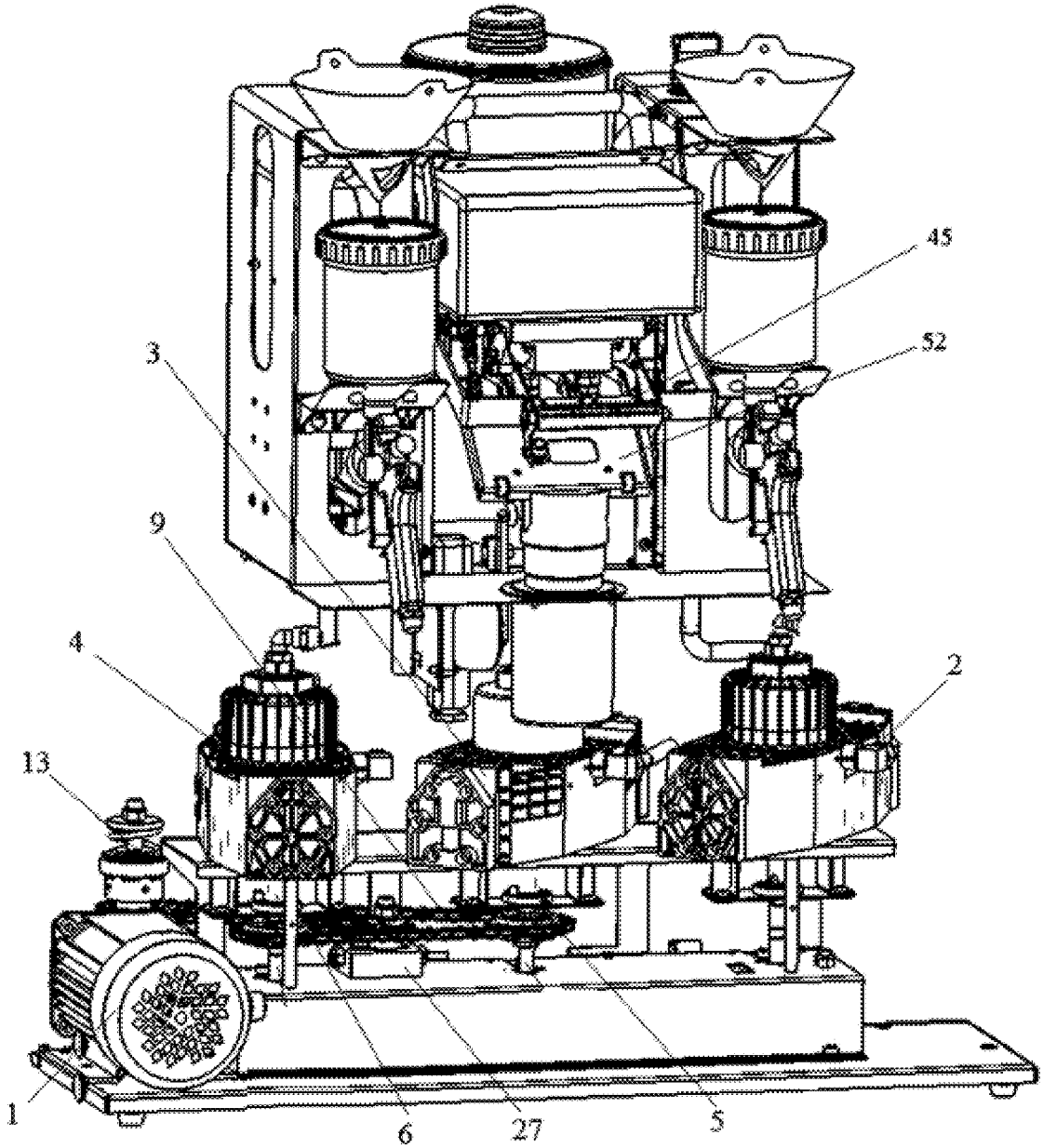
FIG. 2 illustrates a schematic diagram of a partial structure of a proportioning machine according to an embodiment of the present disclosure.
Figure 3:
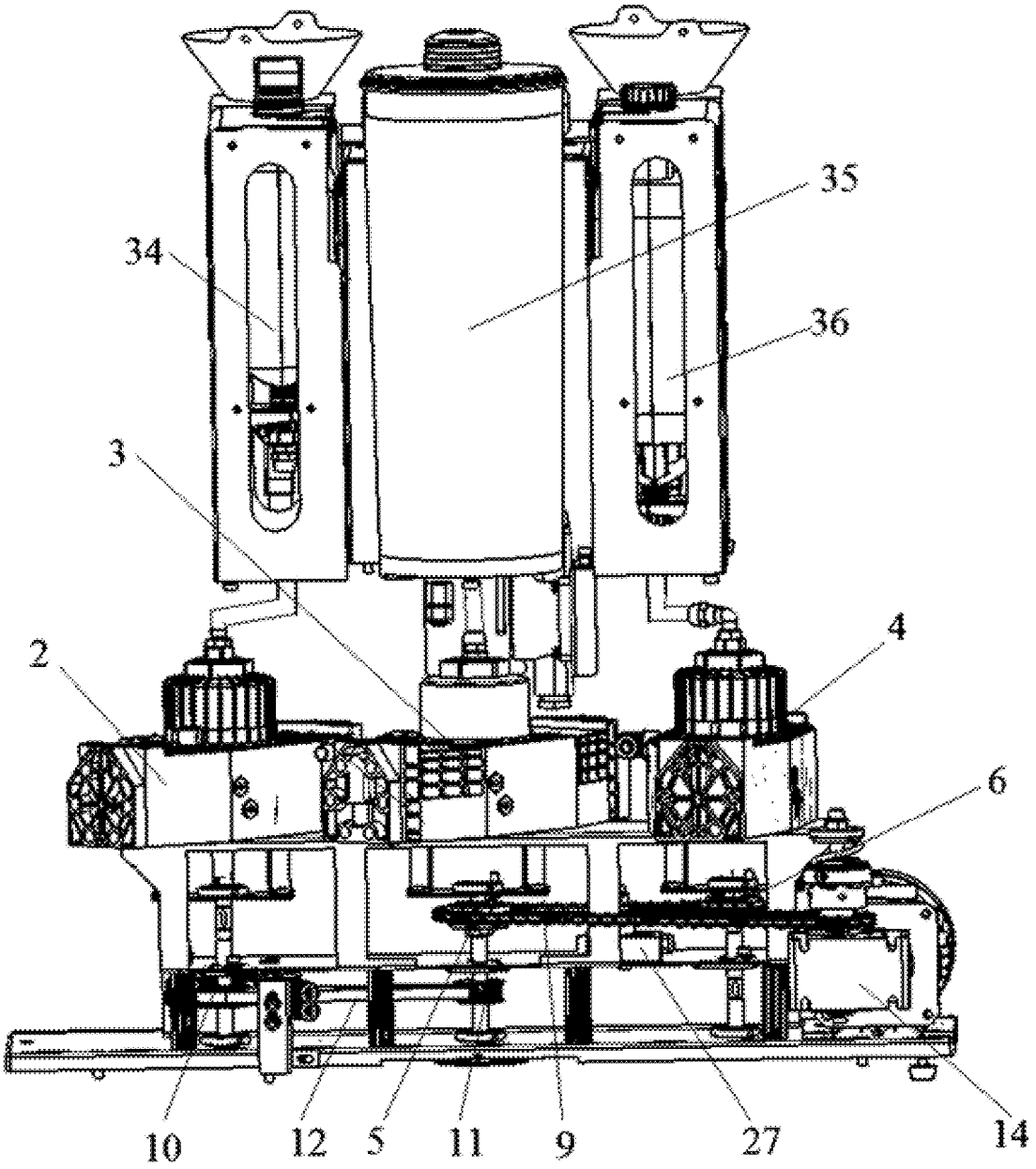
FIG. 3 illustrates a schematic diagram of a partial structure at another angle of a proportioning machine according to an embodiment of the present disclosure.
Figure 4:
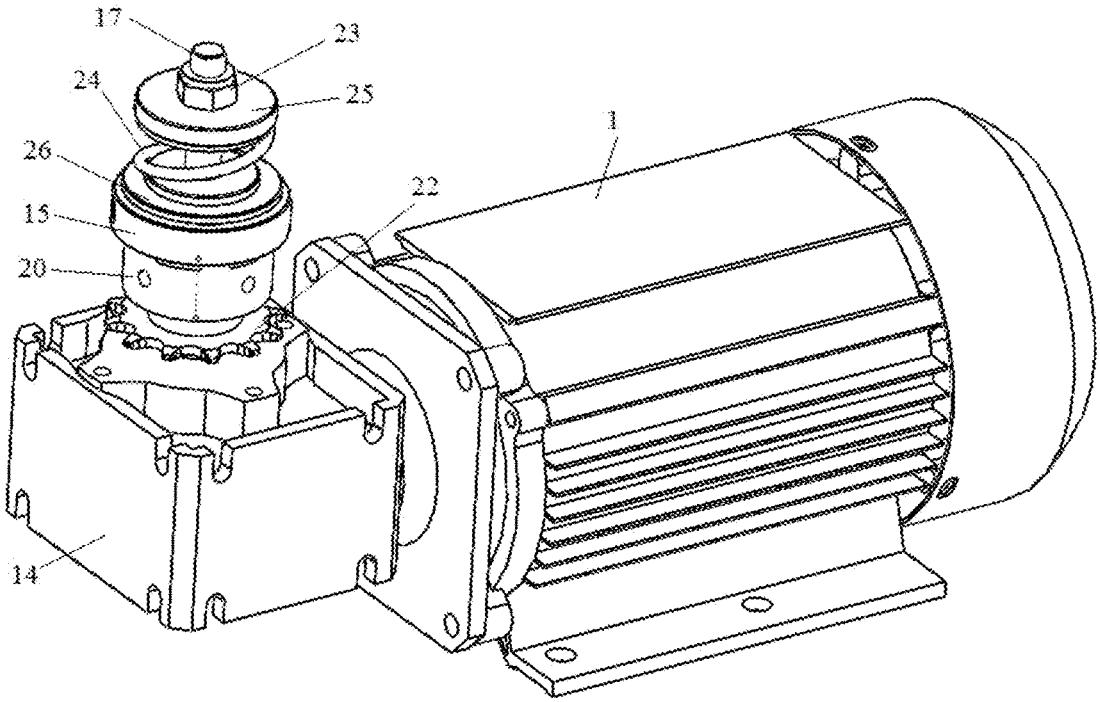
FIG. 4 illustrates schematic structure diagrams of an overload prevention assembly and a driving motor according to an embodiment of the present disclosure.
Figure 5:
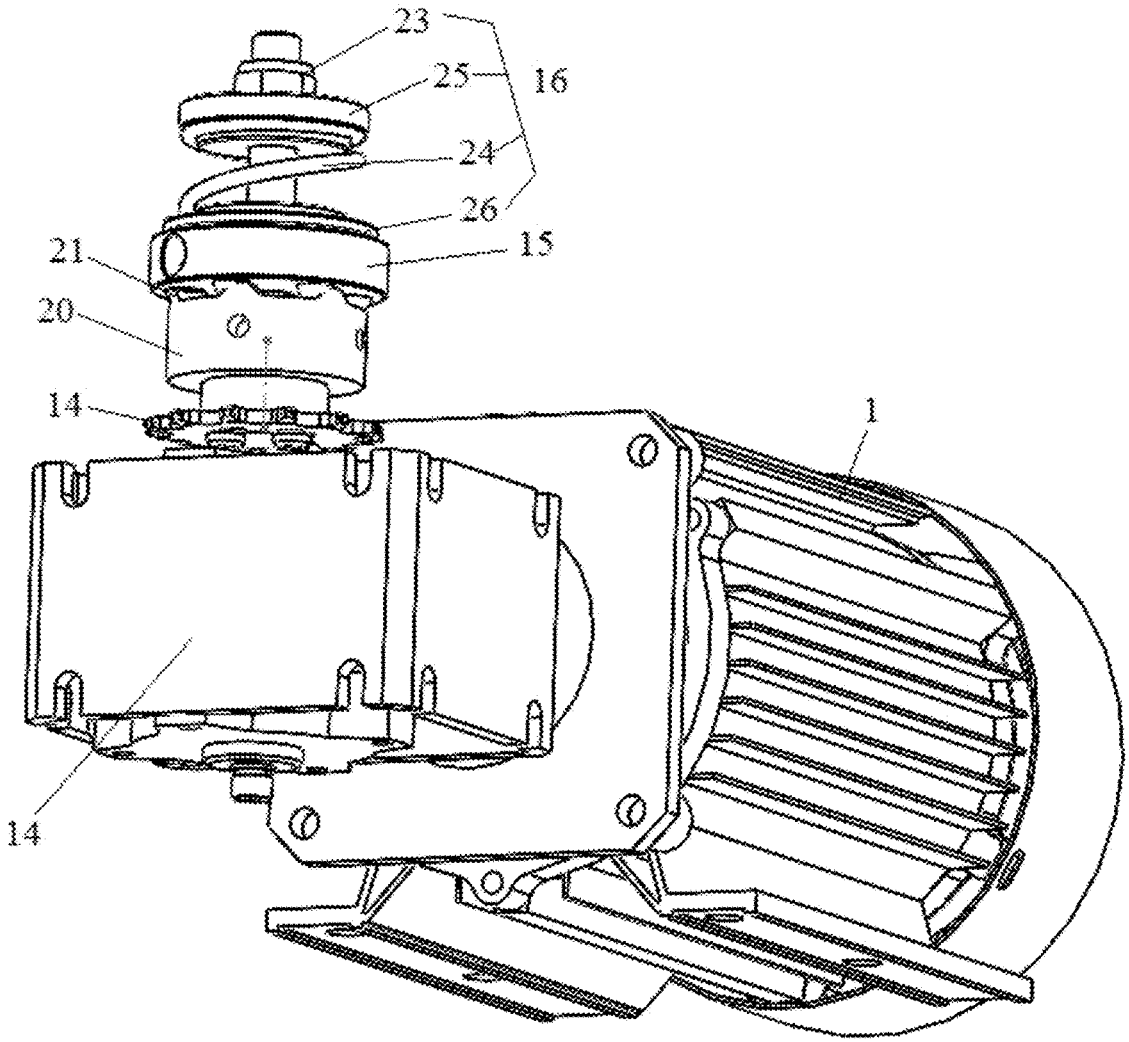
FIG. 5 illustrates schematic structure diagrams at another angle of an overload prevention assembly and a driving motor according to an embodiment of the present disclosure.
Figure 6:
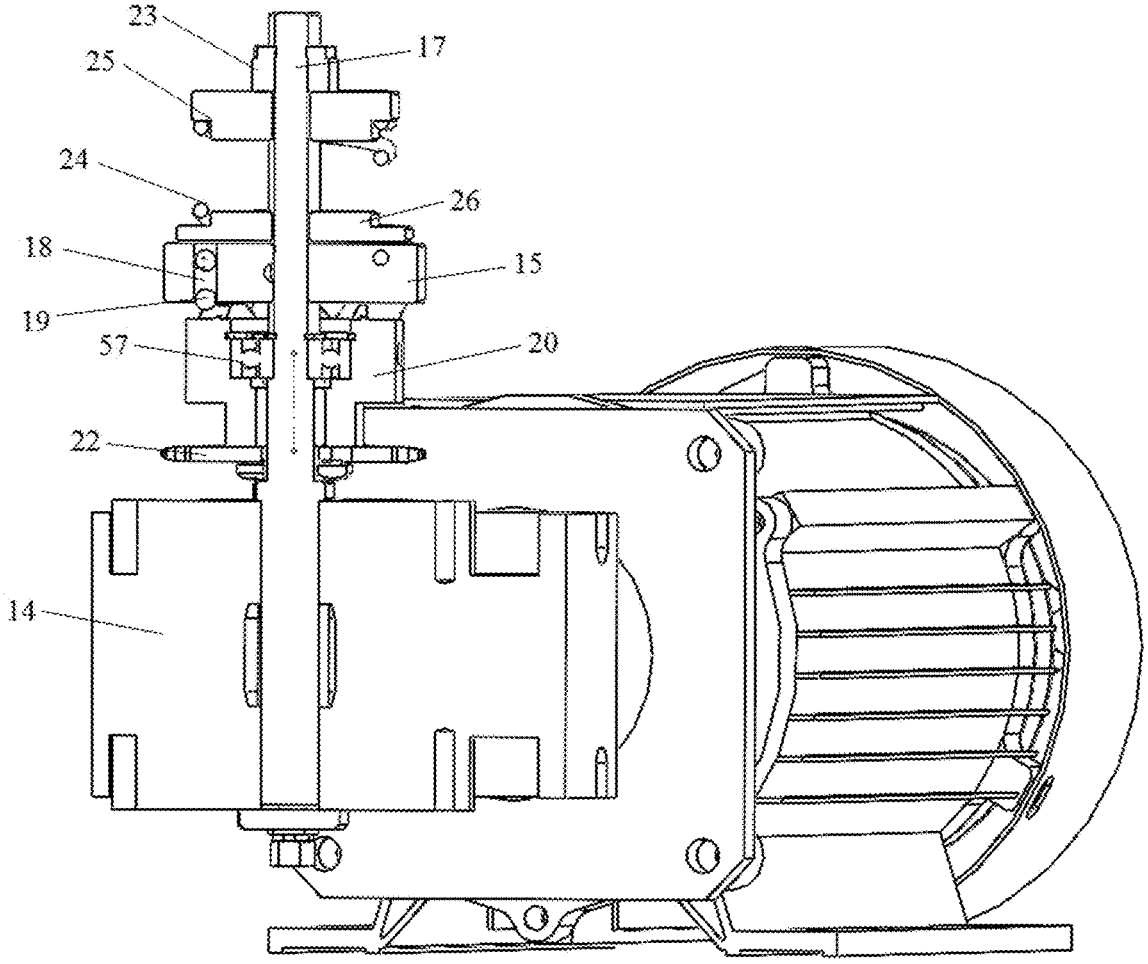
FIG. 6 illustrates a schematic diagram of a cross-sectional view of an overload prevention assembly and a driving motor according to an embodiment of the present disclosure.
Figure 7:
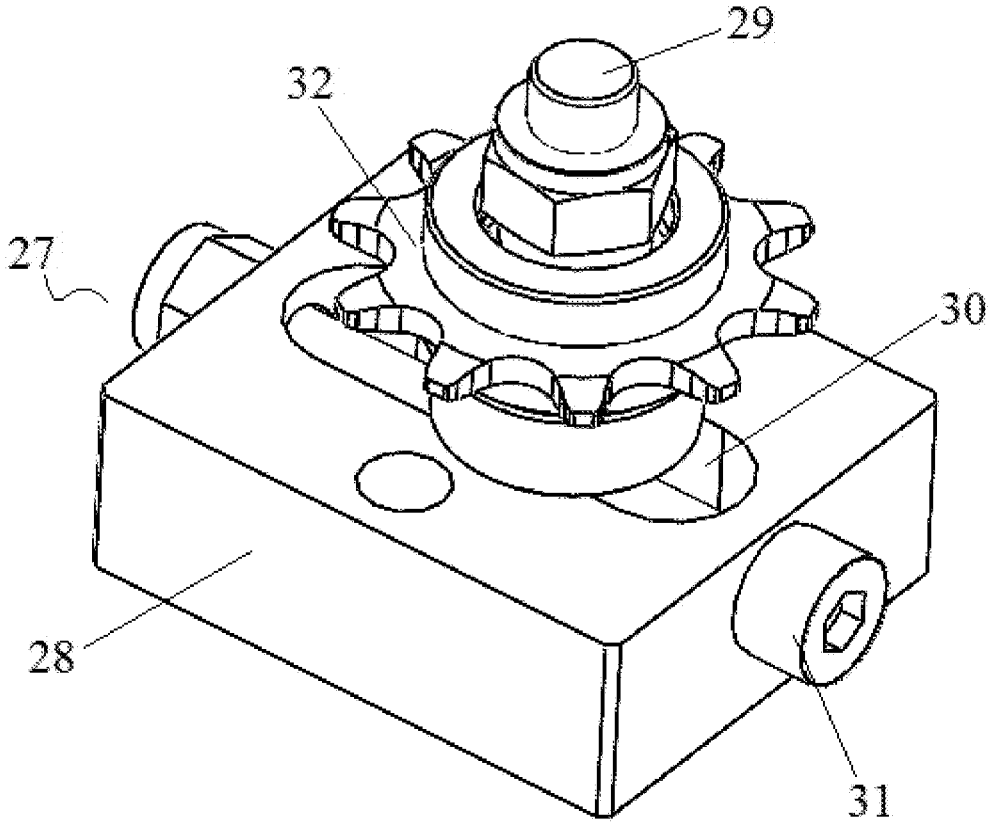
FIG. 7 illustrates a schematic structure diagram of a tension mechanism according to an embodiment of the present disclosure.
Figure 8:
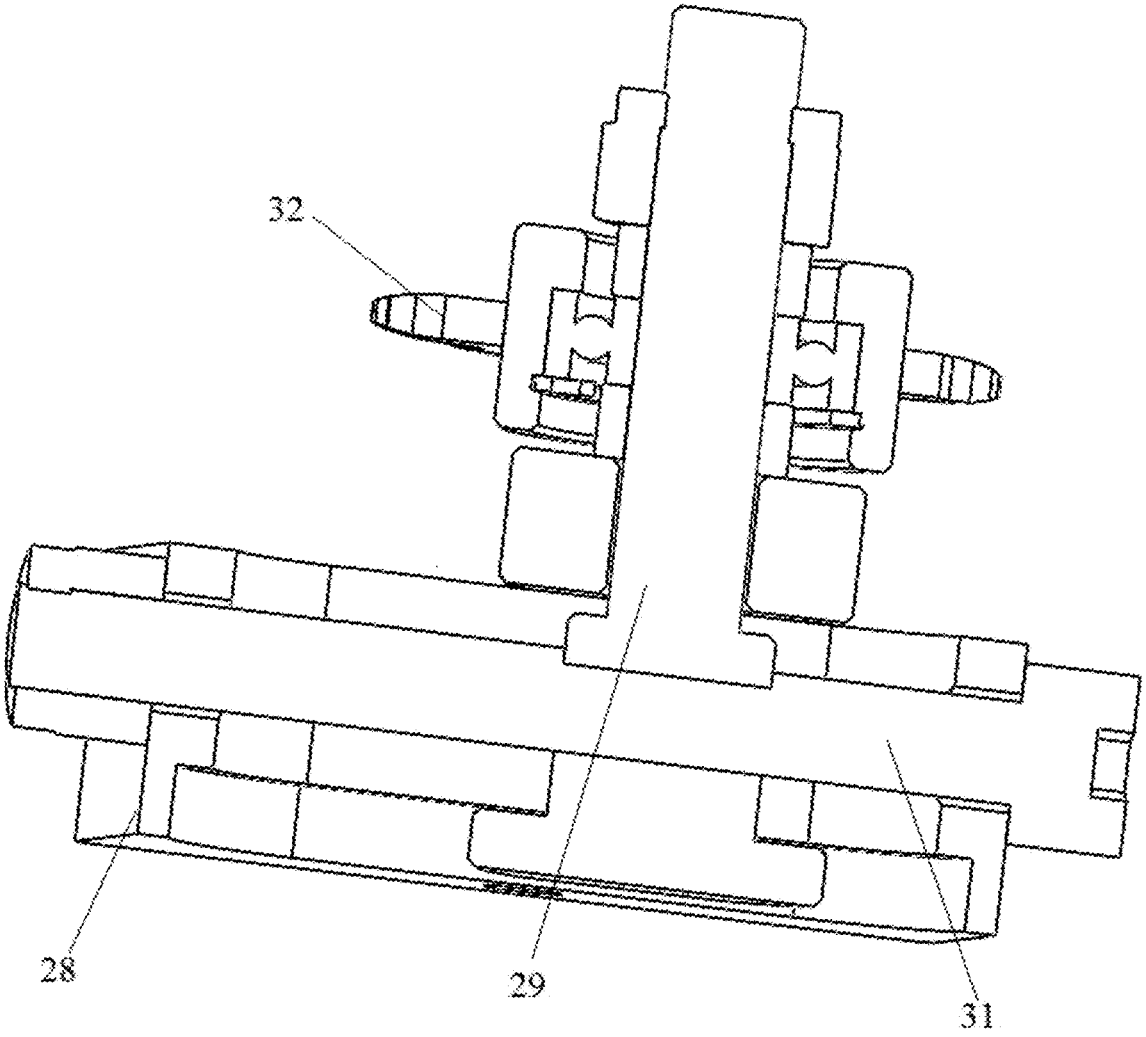
FIG. 8 illustrates a schematic diagram of a cross-sectional view of a tension mechanism according to an embodiment of the present disclosure.
Figure 9:
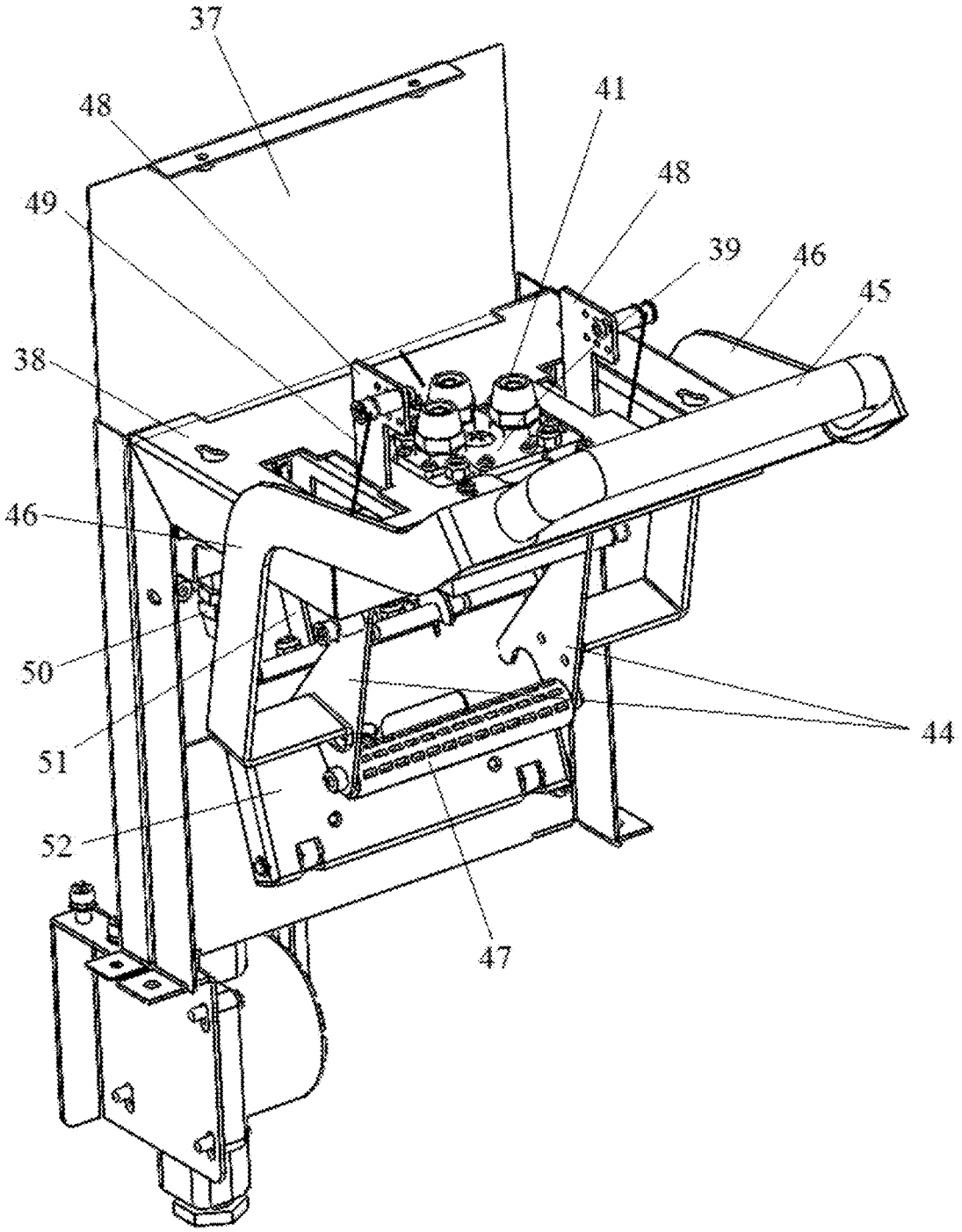
FIG. 9 illustrates a schematic diagram of a partial structure of a proportioning machine according to an embodiment of the present disclosure.
Figure 10:
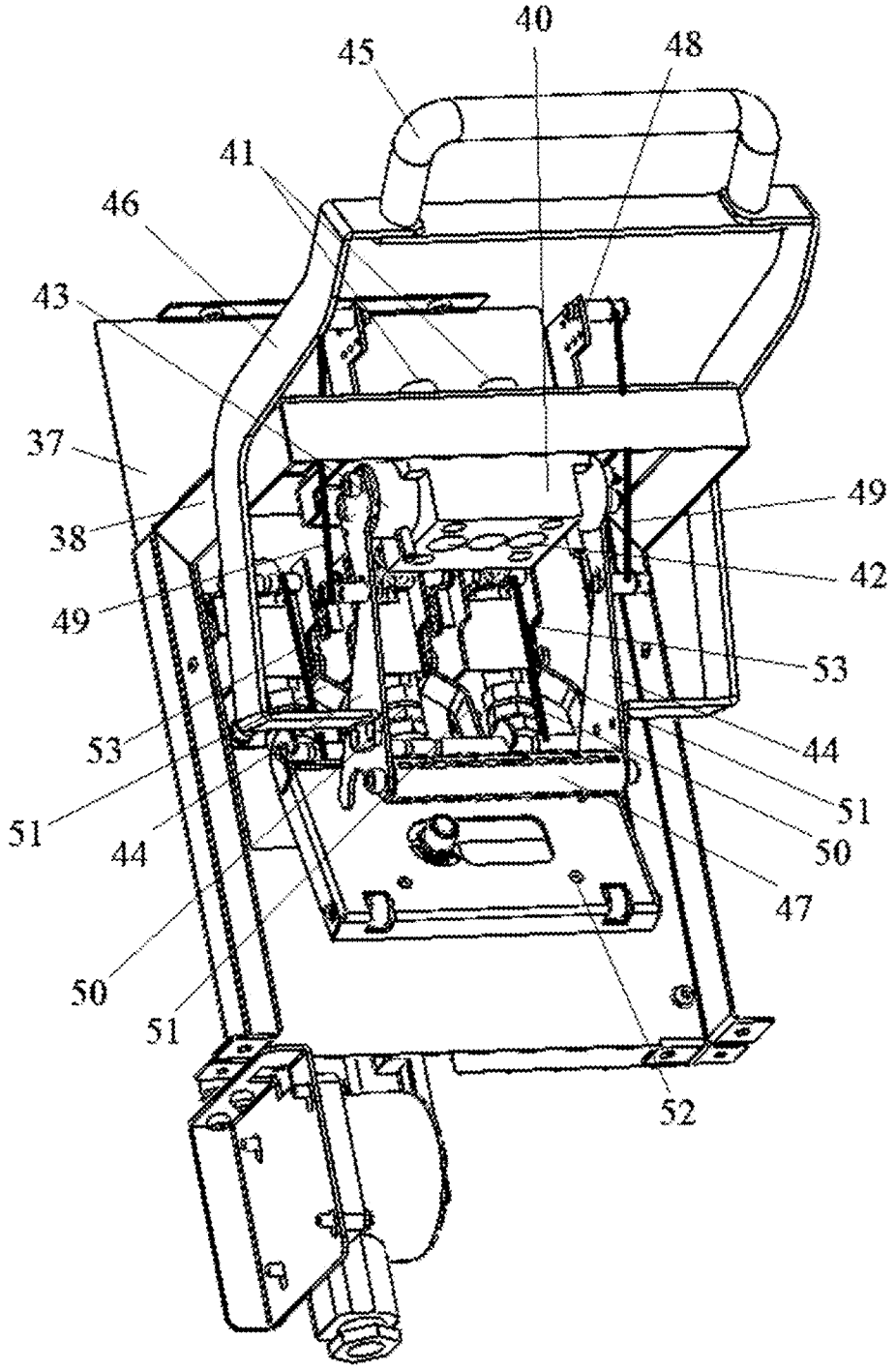
FIG. 10 illustrates a schematic diagram of a partial structure of a proportioning machine according to an embodiment of the present disclosure.
Figure 11:
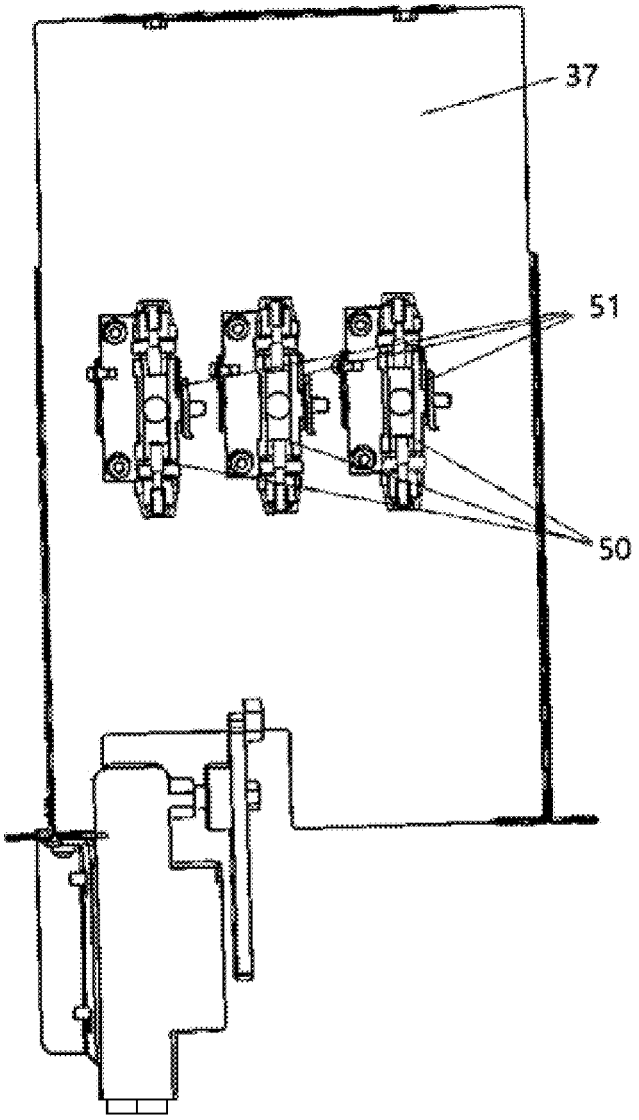
FIG. 11 illustrates a partial schematic diagram of a cross-sectional view of a proportioning machine of FIG. 10.
Figure 12:
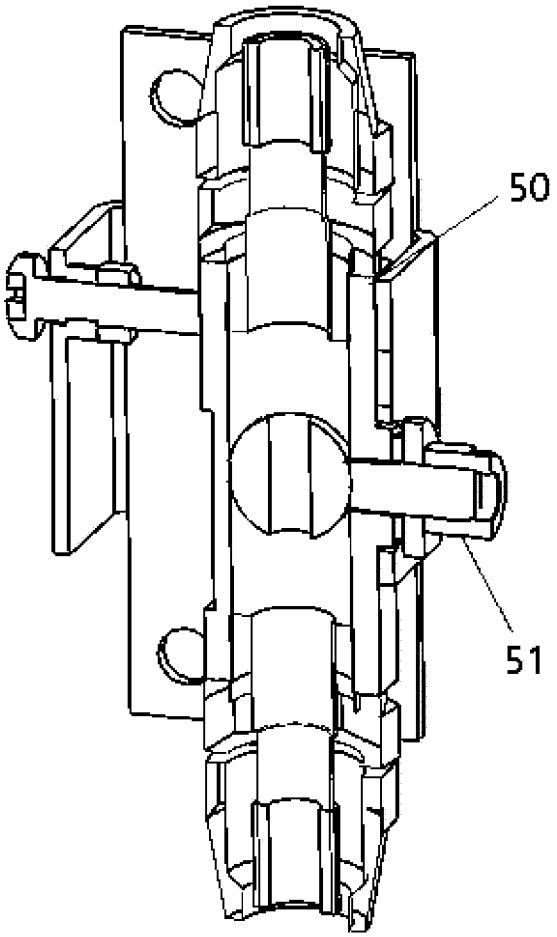
FIG. 12 illustrates a schematic diagram of a cross-sectional view of a nozzle stop valve according to an embodiment of the present disclosure.
Figure 13:
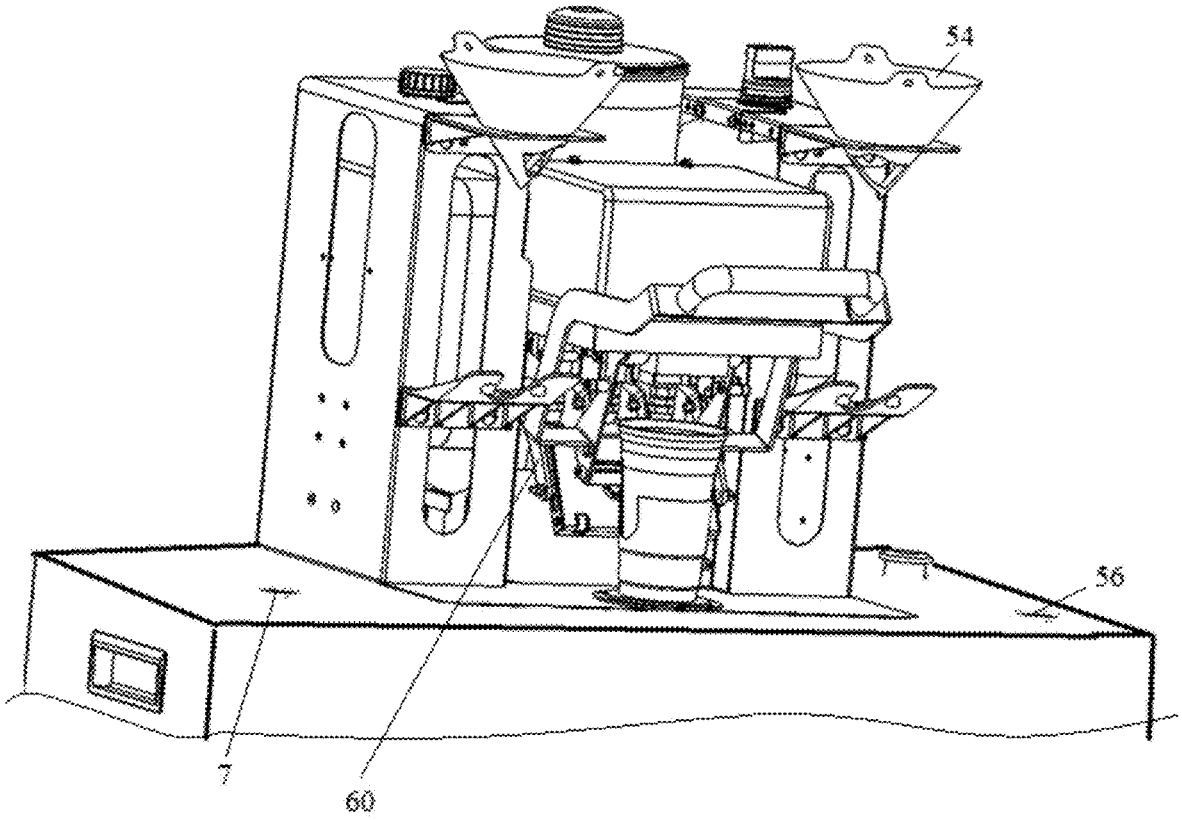
FIG. 13 illustrates a schematic diagram of a partial structure of a proportioning machine according to another embodiment of the present disclosure.
Figure 14:
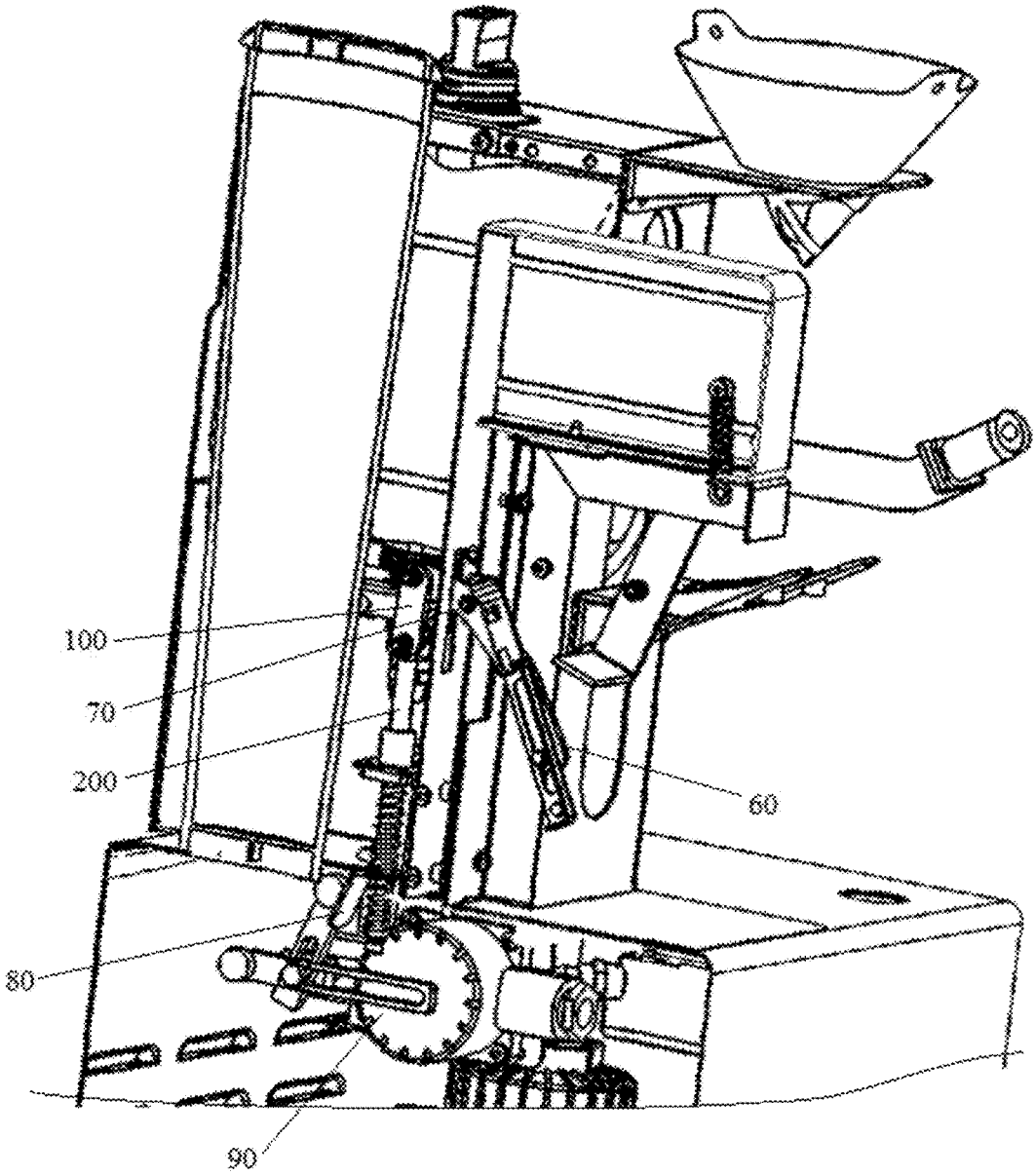
FIG. 14 illustrates a partial schematic diagram of a cross-sectional view of a proportioning machine of FIG. 13.

As shown in FIGS. 1-14, a pump assembly is provided. The pump assembly includes a driving mechanism, including a driving motor 1; a first pump body 2, configured to extract a first solution; a second pump body 3, configured to extract a second solution; and a third pump body 4, configured to extract a diluent. The first pump body 2 and the second pump body 3 are in transmission connection, the second pump body 3 and the third pump body 4 are both in driving connection with the driving motor 1, when the driving motor 1 rotates along a first direction, a rotating shaft of the third pump body 4 does not rotate, the driving motor 1 drives a rotating shaft of the second pump body 3 to rotate, the rotating shaft of the second pump body 3 drives a rotating shaft of the first pump body 2 to rotate, when the driving motor 1 rotates along a second direction, the rotating shafts of the first pump body 2 and the second pump body 3 do not rotate, the driving motor 1 drives the rotating shaft of the third pump body 4 to rotate, and the first direction and the second direction are opposite.

In the embodiment, the first direction is a clockwise direction or a counterclockwise direction, when the first direction is the clockwise direction, the second direction is the counterclockwise direction, and when the first direction is the counterclockwise direction, the second direction is the clockwise direction. The first pump body 2 is configured to extract the first solution and inject the first solution out, the second pump body 3 is configured to extract the second solution and is able to dispense the second solution, the third pump body 4 is configured to extract the diluent and is able to dispense the diluent, the first solution may be a thermosetting resin, the second solution may be a curing agent, after mixing, the two may form a varnish through curing, and the diluent may dilute the proportioned varnish. When the driving motor 1 rotates along the first direction, the driving motor 1 drives the rotating shaft of the second pump body 3 to rotate, the second pump body 3 drives the rotating shaft of the first pump body 2 to rotate, in such a case, the first pump body 2 and the second pump body 3 are in a working state, the first pump body 2 extracts and pumps the first solution out, the second pump body 3 extracts and pumps the second solution out, the third pump body 4 does not work, when the driving motor 1 rotates along the second direction, the driving motor 1 drives the rotating shaft of the third pump body 4 to rotate, the third pump body 4 is in a working state, the third pump body 4 extracts and pumps the diluent out, and the first pump body 2 and the second pump body 3 are in a non-working state.

As described above, when paint proportioning needs to be carried out, the driving motor 1 is enabled to rotate along the first direction firstly, in such a case, the first pump body 2 and the second pump body 3 respectively extract and pump the first solution and the second solution out, after mixing, the first solution and the second solution form liquid varnish, and the varnish is cured to form solid varnish after a diluent is added. A user may add the diluent to the proportioned varnish according to requirements, when the diluent needs to be added, the driving motor 1 rotates along the second direction, in such a case, the first pump body 2 and the second pump body 3 do not work, the third pump body 4 works, and the third pump body 4 extracts and pumps the diluent out. Compared with an existing proportioning machine, in the present disclosure, the pump assembly only needs to be driven by one driving motor 1, a plurality of driving motors land corresponding transmission structures do not need to be disposed, and thus manufacturing cost may be reduced.

It is to be noted that each of the first pump body 2, the second pump body 3 and the third pump body 4 includes a rotating shaft, a speed ratio among the rotating shafts keeps the liquid outlet speeds of the first pump body 2, the second pump body 3 and the third pump body 4 in a certain proportion, the specific proportion may be set according to requirements, and a rotation angle of the rotating shaft determines a liquid outlet amount of the pump body. When the pump assembly of the present disclosure is applied in an actual production, two solutions or three solutions may be mixed according to a preset ratio as required.

In an embodiment, the first pump body 2, the second pump body 3 and the third pump body 4 may be a rotary pump, a plunger pump and the like.

As shown in FIGS. 1-14, in an embodiment of the present disclosure, the pump assembly further includes a first transmission mechanism and a second transmission mechanism, the driving motor 1 is in driving connection with the second pump body 3 and the third pump body 4 through the first transmission mechanism, and the second pump body 3 is in transmission connection with the first pump body 2 through the second transmission mechanism.

Through the above arrangement, the driving motor 1 may be in driving connection with the second pump body 3 and the third pump body 4, the second pump body 3 may be in transmission connection with the first pump body 2, when the driving motor 1 rotates along the first direction, the driving motor 1 drives the rotating shaft of the second pump body 3 to rotate, the second pump body 3 may drive the rotating shaft of the first pump body 2 to rotate, when the driving motor 1 rotates along the second direction, the driving motor 1 may drive the rotating shaft of the third pump body 4 to rotate.

As shown in FIGS. 1-14, in an embodiment of the present disclosure, the first transmission mechanism includes a first chain wheel 5, a second chain wheel 6, a first one-way bearing, a second one-way bearing and a chain 9, the chain 9 is meshed with a motor shaft of the driving motor 1, rotatable directions of the first one-way bearing and the second one-way bearing are opposite, the first chain wheel 5 is installed on the rotating shaft of the second pump body 3 through the first one-way bearing, the second chain wheel 6 is installed on the rotating shaft of the third pump body 4 through the second one-way bearing, the chain 9 sleeves peripheries of the first chain wheel 5 and the second chain wheel 6, and the first chain wheel 5 and the second chain wheel 6 are both meshed with the chain 9. The second transmission mechanism includes a first synchronous belt wheel 10, a second synchronous belt wheel 11 and a synchronous belt 12, the first synchronous belt wheel 10 is installed on the rotating shaft of the first pump body 2, the second synchronous belt wheel 11 is installed on the rotating shaft of the second pump body 3, and the first synchronous belt wheel 10 and the second synchronous belt wheel 11 are in transmission connection through the synchronous belt 12.

In the embodiment, when paint proportioning needs to be carried out, the driving motor 1 rotates along the first direction, the chain 9 drives the first chain wheel 5 to rotate, the first chain wheel 5 drives the rotating shaft of the second pump body 3 and the rotating shaft of the first pump body 2 to rotate at the same time, in such a case, the first pump body 2 and the second pump body 3 work at the same time and respectively extract and dispense the first solution and the second solution, the second chain wheel 6 and the second one-way bearing idle, the second chain wheel 6 cannot drive the rotating shaft of the third pump body 4 to rotate, and the third pump body 4 does not work. When the diluent needs to be added, the driving motor 1 rotates along the second direction, in such a case, the first chain wheel 5 and the first one-way bearing idle, the first chain wheel 5 cannot drive the rotating shaft of the second pump body 3 to rotate, the second pump body 3 and the first pump body 2 cannot work, the chain 9 drives the second chain wheel 6 to rotate, and the second chain wheel 6 drives the rotating shaft of the third pump body 4 to rotate, so that the third pump body 4 extracts and dispenses the diluent. Through the above arrangement, when the third pump body 4 works, the first pump body 2 and the second pump 3 do not work, when the first pump body 2 and the second pump body 3 work, the third pump body 4 does not work, thus paint proportioning is completed.

In an embodiment, a speed ratio between the rotating shaft of the first pump body 2 and the rotating shaft of the second pump body 3 is maintained in a certain proportion, a ratio of speed of liquid injection between the two is 2:1, a radius ratio of the first synchronous belt wheel 10 to a radius ratio of the second synchronous belt wheel 11 is 2:1, and other ratios may also be adopted.

As shown in FIGS. 1-14, in an embodiment of the present disclosure, the pump assembly further includes an overload prevention assembly 13, the overload prevention assembly 13 is installed on the motor shaft of the driving motor 1, the overload prevention assembly 13 includes a driving adjusting part and a transmission part 20, the transmission part 20 is meshed with the chain 9, and the driving adjusting part is configured to be capable of driving the transmission part 20 to rotate.

In the embodiment, the driving adjusting part may drive the transmission part 20 to rotate, so that the transmission part 20 drives the chain 9 to rotate, and then the chain 9 may drive the first chain wheel 5 or the second chain wheel 6 to rotate.

As shown in FIGS. 1-14, in an embodiment of the present disclosure, the driving adjusting part includes a speed reducer 14, a fixed seat 15 and a compression structure 16, a driving shaft 17 is disposed at an output end of the speed reducer 14, the transmission part 20, the fixed seat 15 and the compression structure 16 are all installed on the driving shaft 17, the fixed seat 15 is located between the transmission part 20 and the compression structure 16, the compression structure 16 is located on a side, away from the speed reducer 14, of the fixed seat 15, the compression structure 16 has a driving state and a driving relieving state, when the compression structure 16 is in the driving state, the compression structure 16 is able to drive the transmission part 20 to rotate, and when the compression structure 16 is in the driving relieving state, the compression structure 16 cannot drive the transmission part 20.

An existing proportioning machine may automatically dispense the curing agent and thermosetting resin out according to a set proportion, and then carry out mixing in a container. However, in use, since the valve assembly is manually opened and closed, after an operator gives power to a power apparatus, if the valve assembly is not opened in time for discharging, or the power apparatus is not powered off in time after the valve assembly is discharged, a pressure of a pipeline between the pump assembly and the valve assembly will increase, and when the pressure in the pipeline exceeds a safe pressure value of the pipeline, the pipeline will collapse.

In the embodiment, the compression structure 16 may drive the transmission part 20 to rotate, the transmission part 20 rotates to drive the chain 9 to rotate, then the chain 9 may drive the first chain wheel 5 or the second chain wheel 6 to rotate, and thus dispensation operation of the first solution, the second solution and the diluent is realized. When the pressure in the pipeline is too large, the compression structure 16 is in the driving relieving state, and the compression structure 16 cannot drive the transmission part 20 to rotate, so that the first pump body 2, the second pump body 3 and the third pump body 4 are in a non-working state, the first pump body 2, the second pump body 3 and the third pump body 4 no longer exert driving pressure in the pipeline, so as to ensure the safety of the pipeline, thereby effectively preventing pipe collapse caused by misoperation.

As shown in FIGS. 1-14, in an embodiment of the present disclosure, a through hole 18 is disposed in the fixed seat 15, a steel ball 19 is disposed in the through hole 18, the compression structure 16 is configured to be capable of exerting pressure to the steel ball 19, a plurality of protrusions 21 are disposed on a top of the transmission part 20, the plurality of protrusions 21 are arranged along a circumferential direction of the transmission part 20 at intervals, the steel ball 19 is configured to be capable of being clamped between adjacent two protrusions 21, a driving gear 22 is disposed at a bottom of the transmission part 20, and the driving gear 22 is meshed with the chain 9.

In the embodiment, the fixed seat 15 rotates with the driving shaft 17, the compression structure 16 presses the steel ball 19 downwards, so that a lower part of the steel ball 19 is pressed between two adjacent protrusions 21 to drive the transmission part 20 to rotate, the transmission part 20 rotates to enable the driving gear 22 to rotate, the driving gear 22 is meshed with the chain 9, the chain 9 is meshed with the first chain wheel 5 and the second chain wheel 6, so that the driving gear 22 may drive the rotating shafts of the second pump body 3 and the third pump body 4 to rotate at a preset speed.

As shown in FIGS. 1-14, in an embodiment of the present disclosure, two steel balls 19 are available, in a vertical direction, a top of the steel ball 19 located above is exposed out of the through hole 18, the compression structure 16 may exert pressure to the top of the steel ball 19, a steel ball 19 close to the transmission part 20 is capable of being clamped between the two adjacent protrusions 21, a driving gear 22 is disposed at the bottom of the transmission part 20, and the driving gear 22 is meshed with the chain 9. The compression structure 16 includes an adjusting piece 23, an elastic piece 24, a first pressing plate 25 and a second pressing plate 26, a first end of the elastic piece 24 abuts against the first pressing plate 25, a second end of the elastic piece 24 abuts against the second pressing plate 26, the second pressing plate 26 abuts against the steel ball 19 away from the transmission part 20, the adjusting piece 23 is located on a side, away from the second pressing plate 26, of the first pressing plate 25, and the adjusting piece 23 is able to move along an axial direction of the driving shaft 17, so as to adjust a position of the first pressing plate 25 on the driving shaft 17.

In the embodiment, under an acting force of the elastic piece 24, the second pressing plate 26 presses the steel ball 19 downwards to apply a downward force to the steel ball 19, under the action of the second pressing plate 26, the lower part of the steel ball 19 is pressed between two adjacent protrusions 21, the fixed seat 15 rotates with the driving shaft 17, the steel ball 19 is clamped between the two adjacent protrusions 21 to drive the transmission part 20 to rotate, the transmission part 20 rotates to enable the driving gear 22 to rotate, the driving gear 22 is meshed with the chain 9, and the chain 9 is meshed with the first chain wheel 5 and the second chain wheel 6, so that the driving gear 22 may drive the rotating shafts of the second pump body 3 and the third pump body 4 to rotate at the preset speed. The adjusting piece 23 moves along the axial direction of the driving shaft 17 for adjusting the position of the first pressing plate 25 on the driving shaft 17, so as to adjust a compression degree of the elastic piece 24, the compression degree of the elastic piece 24 is different, the pressure applied to the second pressing plate 26 by the elastic piece 24 is different, the pressure applied to the steel ball 19 by the second pressing plate 26 is also different, and thus driving force of the steel ball 19 to the driving gear 22 may be changed. When liquid resistance in the pipeline is greater than the driving force of the steel ball 19 to the driving gear 22, relative sliding, namely, slipping will occur between the steel ball 19 and the driving gear 22, in such a case, the pressing structure 16 is in the driving relieving state, and each pump body no longer applies driving pressure to the pipeline, so as to ensure the safety of the pipeline.

In an embodiment, the elastic piece is a compression spring, the adjusting piece 23 is a hexagonal nut, by adjusting a position of the hexagonal nut on the driving shaft 17, the position of the first pressing plate 25 on the driving shaft 17 may be adjusted, so that the compression degree of the elastic piece 24 is adjusted, pressure applied by the clastic piece 24 to the second pressing plate 26 is adjusted, then the pressure applied to the steel ball 19 by the second pressing plate 26 is adjusted, the larger the pressure of the second pressing plate 26 to the steel ball 19, the larger the friction force between the steel ball 19 and the two adjacent protrusions 21, the larger the liquid resistance which may be born, and an overload protection value of the overload prevention assembly 13 may be changed through the above arrangement.

In an embodiment, a plurality of through holes 18 are available, by taking the axis of the driving shaft 17 as the circle center, the plurality of through holes 18 are circumferentially disposed on the fixed seat 15, and each through hole 18 internally has a steel ball 19. A rolling bearing 57 is disposed on the driving shaft 17, and the transmission part 20 sleeves outside the rolling bearing 57 and is fixedly connected with the rolling bearing 57.

As shown in FIGS. 1-14, in an embodiment of the present disclosure, the pump assembly further includes a tension mechanism 27, the tension mechanism 27 is located between the first chain wheel 5 and the second chain wheel 6, the tension mechanism 27 includes a tension seat 28 and a tension shaft 29, a strip groove 30 is formed in the tension seat 28, a screw rod 31 is disposed in the strip groove 30 in a penetration manner, a length extension direction of the screw rod 31 is the same as a length extension direction of the strip groove 30, both ends of the screw rod 31 penetrate out of the strip groove 30, a first end of the tension shaft 29 is in threaded match with the screw rod 31, a tension wheel 32 is disposed at a second end of the tension shaft 29, and the tension wheel 32 is meshed with the chain 9.

In the embodiment, the tension wheel 32 and an outer circular surface of the tension shaft 29 are connected by a bearing, the tension wheel 32 is meshed with the chain 9, by rotating the screw rod 31, the tension shaft 29 moves along the length extension direction of the screw rod 31, and then the tightness of the chain 9 may be adjusted.

According to another aspect of the present disclosure, a proportioning machine is provided, which includes the pump assembly described above, and a liquid storage mechanism 33, and a liquid discharge end of the liquid storage mechanism 33 communicates with a liquid outlet end of the pump assembly.

In the embodiment, the pump assembly of the proportioning machine has all technical solutions and all technical effects of the pump assembly described above, which will not be repeated here.

As shown in FIGS. 1-12, in an embodiment of the present disclosure, the liquid storage mechanism 33 includes a first liquid storage unit 34, a second liquid storage unit 35 and a third liquid storage unit 36, a first solution is filled in the first liquid storage unit 34, a liquid outlet end of the first liquid storage unit 34 communicates with a liquid inlet end of the first pump body 2, a second solution is filled in the second liquid storage unit 35, a liquid outlet end of the second liquid storage unit 35 communicates with a liquid inlet end of the second pump body 3, the diluent is filled in the third liquid storage unit 36, and a liquid outlet end of the third liquid storage unit 36 communicates with a liquid inlet end of the third pump body 4.

In the embodiment, the first liquid storage unit 34 is connected with a liquid inlet of the first pump body 2, the second liquid storage unit 35 is connected with a liquid inlet of the second pump body 3, and the third liquid storage unit 36 is connected with a liquid inlet of the third pump body 4.

In an embodiment, the first liquid storage unit 34 is a storage tank, the second liquid storage unit 35 and the third liquid storage unit 36 are soft bags, the soft bags may isolate air, so that change of liquids that are easily volatile or deteriorated may be avoided, a bag cover is disposed on the soft bag, and the bag cover and the soft bag are sealed. After second liquid is added in the soft bag, the soft bag is squeezed by hand for squeezing out rest gas from a bag opening, and then the bag cover is closed for scaling.

In an embodiment, the proportioning machine includes at least two liquid storage mechanisms 33. The liquid storage mechanisms 33, each pump body and a liquid outlet position are connected by pipelines, a valve control switch may also be disposed, the automatic proportioning mode is adopted, manual allocation of the proportion of various liquids is not needed, so that the work efficiency and allocation accuracy may be improved, and the quality of a product is improved. Each pump body includes a rotating shaft, and the rotating shaft rotates to enable the pump body to extract and discharge liquid, such as the pump body in CN203022984U or CN202210266034.X.

As shown in FIGS. 1-14, in an embodiment, the proportioning machine further includes a shell 8 and a cup support seat, the pump assembly is installed in the shell 8, a nozzle paint pipe cover 37 in a shape of a vertical plate, a first inching explosion-proof button 56 enabling the speed reducer 14 to rotate along the first direction and a second inching explosion-proof button 7 enabling the speed reducer 14 to rotate along the second direction are disposed on the shell 8, a tray nozzle holder 38 is disposed on a plate face on a middle-upper part of the nozzle paint pipe cover 37, a column valve three-nozzle assembly 39 is disposed on the tray nozzle holder 38, the column valve three-nozzle assembly 39 includes a three-nozzle valve body 40 fixed on the tray nozzle holder 38, a pipe joint 41 communicating with liquid outlets of the first pump body 2, the second pump body 3 and the third pump body 4 is disposed on a top of the three-nozzle valve body 40, a paint outlet 42 is disposed at a bottom of the three-nozzle valve body 40, a cavity penetrating left and right is disposed in a middle of the three-nozzle valve body 40, a three-nozzle valve rod 43 is disposed in the cavity, left and right ends of the three-nozzle valve rod 43 penetrate out of the cavity, each of the left and right ends of the three-nozzle valve rod 43 is connected with a plunger piston nozzle pull rod 44, an end part of the plunger piston nozzle pull rod 44 extends out in front of the column valve three-nozzle assembly 39, and in order to facilitate operation, two plunger piston nozzle pull rods 44 are connected through a first handle 45. In order to operate the plunger piston nozzle pull rod 44 more effortlessly and conveniently, a nozzle upper driving arm 46 may be disposed on each plunger piston nozzle pull rod 44, the two nozzle upper driving arms 46 are connected through a second handle 47, a length of the nozzle upper driving arm 46 is greater than a length of the plunger piston nozzle pull rod 44, and a tail end of the nozzle upper driving arm 46 is higher than a tail end of the plunger piston nozzle pull rod 44, so as to facilitate an operator to grasp and exert force.

When liquid needs to be dispensed out, before a disposable plastic cup is placed, the operator downwards pulls the first handle 45 or the second handle 47, the three-nozzle valve rod 43 rotates in the three-nozzle valve body 40 under driving of the plunger piston nozzle pull rod 44, a channel in the three-nozzle valve body 40 communicates with the pipe joint 41 and the paint outlet 42, and in such a case, the column valve three-nozzle assembly 39 is in a discharge state.

As shown in FIGS. 1-14, in an embodiment of the present disclosure, the proportioning machine further includes a switch valve driving arm 60, a switch valve driving shaft 70, a compression spring baffle plate 80, an explosion-proof travel switch 90, a connector 100 and a rotating rod 200, the plunger piston nozzle pull rod 44 drives the nozzle switch guide plate 52 to rotate, so that the nozzle switch guide plate 52 drives the switch valve driving arm 60 to rotate around the switch valve driving shaft 70, the connector 100 is connected between the switch valve driving arm 60 and the rotating rod 200, the switch valve driving arm 60 pulls the rotating rod 200 to move up and down through the connector 100 while rotating, the compression spring baffle plate 80 is disposed at an end, away from the connector 100, of the rotating rod 200, the rotating rod 200 moves up and down to drive the compression spring baffle plate 80 to move, in the moving process, the compression spring baffle plate 80 triggers the explosion-proof travel switch 90, so that the speed reducer 14 is in working state capable of being powered, in such a case, the disposable plastic cup is placed in the cup support seat, the speed reducer 14 may be started by pressing the first inching explosion-proof button 56, the speed reducer 14 may reverse by dispensing paint materials with required proportion or pressing the second inching explosion-proof button 7, and the diluent meeting requirements is independently dispensed out.

The pressing time for the first inching explosion-proof button 56 and the second inching explosion-proof button 7 may control the dispensation amount, when discharge of the column valve three-nozzle assembly 39 is completed, the first handle 45 or the second handle 47 is manually pulled upwards, the three-nozzle valve rod 43 rotates reversely in the three-nozzle valve body 40 under driving of the plunger piston nozzle pull rod 44, and communication of the channel in the three-nozzle valve body 40 with the pipe joint 41 and the paint outlet 42 is disconnected. In order to facilitate conversion between the discharge state and the non-discharge state of the column valve three-nozzle assembly 39, a column valve nozzle tension spring seat 48 is further disposed on the tray nozzle holder 38, a first tension spring 49 is disposed on the column valve nozzle tension spring seat 48, one end of the first tension spring 49 is connected with a middle of the plunger piston nozzle pull rod 44, under the discharge state, the plunger piston nozzle pull rod 44 twists downwards, the first tension spring 49 is in a stretched state, after discharge is completed, the plunger piston nozzle pull rod 44 is released, the plunger piston nozzle pull rod 44 is under the action of pull force of the first tension spring 49, and the column valve three-nozzle assembly 39 returns to the closing state.

In an embodiment, in order to better isolate air and prevent air from entering the pipeline, the first pump body 2, the second pump body 3, the third pump body 4 and the three-nozzle valve body 40 due to seal failure of the column valve three-nozzle assembly 39, causing liquid solidification in the pipeline, the first pump body 2, the second pump body 3 and the third pump body 4, which is resulting in abandonment of the pipeline, the first pump body 2, the second pump body 3 and the third pump body 4, a nozzle stop valve 50 is disposed on each of a pipeline between the first pump body 2 and the column valve three-nozzle assembly 39, a pipeline between the second pump body 3 and the column valve three-nozzle assembly 39, and a pipeline between the third pump body 4 and the column valve three-nozzle assembly 39, and the nozzle stop valve 50 is installed on the nozzle paint pipe cover 37. The nozzle stop valves 50 are three ball valves installed in parallel, one ball valve is installed on each of pipelines of the first liquid storage unit 34 respectively, the second liquid storage unit 35 and the third liquid storage unit 36, in order to enable the nozzle stop valve 50 and the valve body to be opened and closed at the same time, a nozzle stop valve wrench 51 is installed on a control rod of each of the three ball valves of the nozzle stop valve 50, top ends of the three nozzle stop valve wrenches 51 are connected with a nozzle switch guide plate 52, a lower end of the plunger piston nozzle pull rod 44 is of a convex structure, in the process that the plunger piston nozzle pull rod 44 rotates downwards, the convex structure at the lower end of the plunger piston nozzle pull rod 44 pushes against an upper plate face of the nozzle switch guide plate 52, and the nozzle switch guide plate 52 drives the nozzle stop valve wrench 51 to open the nozzle stop valve 50 for allowing liquid to pass the nozzle stop valve 50.

After discharge is completed, in order to enable the nozzle stop valve 50 to be automatically closed, a second tension spring 53 is disposed between the nozzle stop valve 50 and the nozzle switch guide plate 52, the second tension spring 53 always exerts an oblique upward force on the nozzle switch guide plate 52, at the same time, the first tension spring 49 may also apply certain pull force, so that the nozzle stop valve 50 may be automatically closed.

In addition, a filter 54 and a spray gun 55 are further disposed on the shell 8, and the proportioned varnish may be sprayed out through the spray gun 55 after being filtered by the filter 54. When paint proportioning is needed, a paint proportioning cup is placed at the liquid outlet position, the driving motor 1 is powered, so that the driving motor 1 rotates along the first direction, the first liquid and the second liquid at a certain proportion flow out from the paint outlet 42 at the liquid outlet position, after an appropriate amount of liquid is taken, power supply for the motor is stopped, the driving motor 1 is enabled to rotate along the second direction, an appropriate amount of diluent is taken, and stirring is carried out for use.

From above description, it can be seen that the above embodiment of the present disclosure realizes the following technical effects: the driving motor rotates along the first direction, the first pump body and the second pump body respectively extract and pump the first solution and the second solution out, after mixing, the first solution and the second solution form a liquid varnish, the varnish is cured to form solid varnish after the diluent is added, a user may add the diluent to the proportioned varnish according to requirements, when the diluent needs to be added, the driving motor rotates along the second direction, in such a case, the first pump body and the second pump body do not work, the third pump body works, and the third pump body extracts and pumps the diluent out. Compared with an existing proportioning machine, in the present disclosure, the pump assembly only needs to be driven by one driving motor, a plurality of driving motors and corresponding transmission structures do not need to be disposed, and thus manufacturing cost may be reduced.

It is apparent that the above-described embodiments are only some, but not all, embodiments of the present disclosure. All other embodiments obtained by those of ordinary skill in the art based on the embodiments of the present disclosure without creative efforts shall fall within the protection scope of the present disclosure.

It is to be noted that terms used herein are for the purpose of describing specific implementation modes only and are not intended to be limiting of exemplary implementation modes according to the present disclosure. Unless otherwise directed by the context, singular forms of terms used herein are intended to include plural forms. Besides, it will be also appreciated that when terms "contain" and/or "include" are used in the description, it is indicated that features, steps, operations, devices, assemblies and/or a combination thereof exist.

The above is only some embodiments of the present disclosure and is not intended to limit the present disclosure, and those skilled in the art may make various modifications and variations. Any modifications, equivalent replacements, improvements and the like made within the spirit and principle of the present disclosure shall fall within the scope of protection of the present disclosure.

The invention claimed is:

1. A pump assembly, comprising:

a driving mechanism, comprising a driving motor;

a first pump body, configured to extract a first solution;

a second pump body, configured to extract a second solution; and a third pump body, configured to extract a diluent, the first pump body and the second pump body are in transmission connection, the second pump body and the third pump body are both in driving connection with the driving motor, when the driving motor rotates along a first direction, a rotating shaft of the third pump body does not rotate, the driving motor drives a rotating shaft of the second pump body to rotate, the rotating shaft of the second pump body drives a rotating shaft of the first pump body to rotate, when the driving motor rotates along a second direction, the rotating shafts of the first pump body and the second pump body do not rotate, the driving motor drives the rotating shaft of the third pump body to rotate, and the first direction and the second direction are opposite.

2. The pump assembly according to claim 1, wherein the pump assembly further comprises a first transmission mechanism and a second transmission mechanism, the driving motor is in driving connection with the second pump body and the third pump body through the first transmission mechanism, and the second pump body is in transmission connection with the first pump body through the second transmission mechanism.

3. The pump assembly according to claim 2, wherein the first transmission mechanism comprises a first chain wheel, a second chain wheel, a first one-way bearing, a second one-way bearing and a chain, the chain is meshed with a motor shaft of the driving motor, rotatable directions of the first one-way bearing and the second one-way bearing are opposite, the first chain wheel is installed on the rotating shaft of the second pump body through the first one-way bearing, the second chain wheel is installed on the rotating shaft of the third pump body through the second one-way bearing, the chain sleeves peripheries of the first chain wheel and the second chain wheel, and the first chain wheel and the second chain wheel are both meshed with the chain.

4. The pump assembly according to claim 2, wherein the second transmission mechanism comprises a first synchronous belt wheel, a second synchronous belt wheel and a synchronous belt, the first synchronous belt wheel is installed on the rotating shaft of the first pump body, the second synchronous belt wheel is installed on the rotating shaft of the second pump body, and the first synchronous belt wheel and the second synchronous belt wheel are in transmission connection through the synchronous belt.

5. The pump assembly according to claim 3, wherein the pump assembly further comprises an overload prevention assembly, the overload prevention assembly is installed on the motor shaft of the driving motor, the overload prevention assembly comprises a driving adjusting part and a transmission part, the transmission part is meshed with the chain, and the driving adjusting part is configured to be capable of driving the transmission part to rotate.

6. The pump assembly according to claim 5, wherein the driving adjusting part comprises a speed reducer, a fixed seat and a compression structure, a driving shaft is disposed at an output end of the speed reducer, the transmission part, the fixed seat and the compression structure are all installed on the driving shaft, the fixed seat is located between the transmission part and the compression structure, the compression structure is located on a side, away from the speed reducer, of the fixed seat, the compression structure has a driving state and a driving relieving state, when the compression structure is in the driving state, the compression structure is able to drive the transmission part to rotate, and when the compression structure is in the driving relieving state, the compression structure cannot drive the transmission part to rotate.

7. The pump assembly according to claim 6, wherein a through hole is formed in the fixed seat, at least one steel ball is disposed in the through hole, the compression structure is configured to be capable of exerting pressure to the at least one steel ball, a plurality of protrusions are disposed on a top of the transmission part, the plurality of protrusions are arranged along a circumferential direction of the transmission part at intervals, the at least one steel ball is configured to be capable of being clamped between adjacent two protrusions, a driving gear is disposed at a bottom of the transmission part, and the driving gear is meshed with the chain.

8. The pump assembly according to claim 7, wherein the compression structure comprises an adjusting piece, an elastic piece, a first pressing plate and a second pressing plate, a first end of the elastic piece abuts against the first pressing plate, a second end of the elastic piece abuts against the second pressing plate, the second pressing plate abuts against one of the at least one steel ball away from the transmission part, the adjusting piece is located on a side, away from the second pressing plate, of the first pressing plate, and the adjusting piece is able to move along an axial direction of the driving shaft, so as to adjust a position of the first pressing plate on the driving shaft.

9. The pump assembly according to claim 3, wherein the pump assembly further comprises a tension mechanism, the tension mechanism is located between the first chain wheel and the second chain wheel, the tension mechanism comprises a tension seat and a tension shaft, a strip groove is formed in the tension seat, a screw rod is disposed in the strip groove in a penetration manner, a length extension direction of the screw rod is the same as a length extension direction of the strip groove, both ends of the screw rod penetrate out of the strip groove, a first end of the tension shaft is in threaded match with the screw rod, a tension wheel is disposed at a second end of the tension shaft, and the tension wheel is meshed with the chain.

10. A proportioning machine, comprising:

the pump assembly according to claim 1;

a liquid storage mechanism, and a liquid discharge end of the liquid storage mechanism communicates with a liquid outlet end of the pump assembly.

11. The proportioning machine according to claim 10, wherein the liquid storage mechanism comprises a first liquid storage unit, a second liquid storage unit and a third liquid storage unit, a first solution is filled in the first liquid storage unit, a liquid outlet end of the first liquid storage unit communicates with a liquid inlet end of the first pump body, a second solution is filled in the second liquid storage unit, a liquid outlet end of the second liquid storage unit communicates with a liquid inlet end of the second pump body, the diluent is filled in the third liquid storage unit, and a liquid outlet end of the third liquid storage unit communicates with a liquid inlet end of the third pump body.

12. The proportioning machine according to claim 10, wherein the pump assembly further comprises a first transmission mechanism and a second transmission mechanism, the driving motor is in driving connection with the second pump body and the third pump body through the first transmission mechanism, and the second pump body is in transmission connection with the first pump body through the second transmission mechanism.

13. The proportioning machine according to claim 12, wherein the first transmission mechanism comprises a first chain wheel, a second chain wheel, a first one-way bearing, a second one-way bearing and a chain, the chain is meshed with a motor shaft of the driving motor, rotatable directions of the first one-way bearing and the second one-way bearing are opposite, the first chain wheel is installed on the rotating shaft of the second pump body through the first one-way bearing, the second chain wheel is installed on the rotating shaft of the third pump body through the second one-way bearing, the chain sleeves peripheries of the first chain wheel and the second chain wheel, and the first chain wheel and the second chain wheel are both meshed with the chain.

14. The proportioning machine according to claim 12, wherein the second transmission mechanism comprises a first synchronous belt wheel, a second synchronous belt wheel and a synchronous belt, the first synchronous belt wheel is installed on the rotating shaft of the first pump body, the second synchronous belt wheel is installed on the rotating shaft of the second pump body, and the first synchronous belt wheel and the second synchronous belt wheel are in transmission connection through the synchronous belt.

15. The proportioning machine according to claim 13, wherein the pump assembly further comprises an overload prevention assembly, the overload prevention assembly is installed on the motor shaft of the driving motor, the overload prevention assembly comprises a driving adjusting part and a transmission part, the transmission part is meshed with the chain, and the driving adjusting part is configured to be capable of driving the transmission part to rotate.

16. The proportioning machine according to claim 15, wherein the driving adjusting part comprises a speed reducer, a fixed seat and a compression structure, a driving shaft is disposed at an output end of the speed reducer, the transmission part, the fixed seat and the compression structure are all installed on the driving shaft, the fixed seat is located between the transmission part and the compression structure, the compression structure is located on a side, away from the speed reducer, of the fixed seat, the compression structure has a driving state and a driving relieving state, when the compression structure is in the driving state, the compression structure is able to drive the transmission part to rotate, and when the compression structure is in the driving relieving state, the compression structure cannot drive the transmission part to rotate.

17. The proportioning machine according to claim 16, wherein a through hole is formed in the fixed seat, at least one steel ball is disposed in the through hole, the compression structure is configured to be capable of exerting pressure to the at least one steel ball, a plurality of protrusions are disposed on a top of the transmission part, the plurality of protrusions are arranged along a circumferential direction of the transmission part at intervals, the at least one steel ball is configured to be capable of being clamped between adjacent two protrusions, a driving gear is disposed at a bottom of the transmission part, and the driving gear is meshed with the chain.

18. The proportioning machine according to claim 17, wherein the compression structure comprises an adjusting piece, an elastic piece, a first pressing plate and a second pressing plate, a first end of the elastic piece abuts against the first pressing plate, a second end of the elastic piece abuts against the second pressing plate, the second pressing plate abuts against one of the at least one steel ball away from the transmission part, the adjusting piece is located on a side, away from the second pressing plate, of the first pressing plate, and the adjusting piece is able to move along an axial direction of the driving shaft, so as to adjust a position of the first pressing plate on the driving shaft.

19. The proportioning machine according to claim 13, wherein the pump assembly further comprises a tension mechanism, the tension mechanism is located between the first chain wheel and the second chain wheel, the tension mechanism comprises a tension seat and a tension shaft, a strip groove is formed in the tension seat, a screw rod is disposed in the strip groove in a penetration manner, a length extension direction of the screw rod is the same as a length extension direction of the strip groove, both ends of the screw rod penetrate out of the strip groove, a first end of the tension shaft is in threaded match with the screw rod, a tension wheel is disposed at a second end of the tension shaft, and the tension wheel is meshed with the chain.

* * * * *